US008958570B2

(12) United States Patent
Matsuo

(10) Patent No.: US 8,958,570 B2
(45) Date of Patent: Feb. 17, 2015

(54) MICROPHONE ARRAY APPARATUS AND STORAGE MEDIUM STORING SOUND SIGNAL PROCESSING PROGRAM

(75) Inventor: Naoshi Matsuo, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 267 days.

(21) Appl. No.: 13/425,717

(22) Filed: Mar. 21, 2012

(65) Prior Publication Data

US 2012/0275620 A1 Nov. 1, 2012

(30) Foreign Application Priority Data

Apr. 28, 2011 (JP) ..... 2011-101775

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2410/07* (2013.01)
USPC ..... 381/92; 381/91; 381/94.1; 381/94.2; 381/94.3; 381/122; 381/71.1; 381/56

(58) Field of Classification Search
USPC ..... 381/92, 94.1, 94.2, 94.3, 91, 122, 71.1, 381/56, 66, 313; 704/205, 225, 226
See application file for complete search history.

(56) References Cited

U.S. PATENT DOCUMENTS

| | | | |
|---|---|---|---|
| 2004/0161120 A1 | 8/2004 | Petersen et al. | |
| 2005/0213778 A1 | 9/2005 | Buck et al. | |
| 2006/0133622 A1 * | 6/2006 | Chen | 381/92 |
| 2009/0002498 A1 | 1/2009 | Oku | |

FOREIGN PATENT DOCUMENTS

| | | |
|---|---|---|
| EP | 1 571 875 A2 | 9/2005 |
| JP | 2005-269649 | 9/2005 |
| JP | 2008-263483 | 10/2008 |
| JP | 2008-263498 | 10/2008 |
| JP | 2009-55583 | 3/2009 |
| JP | 2009-218764 | 9/2009 |
| JP | 2010-026485 | 2/2010 |
| WO | WO2012/078670 A1 | 6/2012 |

OTHER PUBLICATIONS

Great Britain Search Report dated Aug. 15, 2012 in Great Britain Application No. 1206721.1.
Japanese Office Action dated Oct. 21, 2014 in corresponding Japanese Patent Application No. 2011-101775.

* cited by examiner

*Primary Examiner* — Paul S Kim
(74) *Attorney, Agent, or Firm* — Staas & Halsey LLP

(57) ABSTRACT

A microphone array apparatus includes: an acquisition unit configured to acquire samples from a sound signal inputted from each of a plurality of microphones, at predetermined time intervals; an operation unit configured to calculate a value based on volumes of the sound signal possessed by a plurality of the samples for each of the sound signals inputted from the plurality of microphones; a correlation coefficient calculator configured to calculate a coefficient of correlation between the sound signals, on the basis of the values calculated for the respective sound signals; and a gain calculator configured to calculate reduction gain for the sound signals inputted from the plurality of microphones, on the basis of the coefficient of correlation.

17 Claims, 13 Drawing Sheets

MICROPHONE ARRAY APPARATUS AND STORAGE MEDIUM STORING SOUND SIGNAL PROCESSING PROGRAM

CROSS-REFERENCE TO RELATED APPLICATION

This application is based upon and claims the benefit of priority of the prior Japanese Patent Application No. 2011-101775, filed on Apr. 28, 2011, the entire contents of which are incorporated herein by reference.

FIELD

The embodiments disclosed herein are related to a microphone array apparatus and a storage medium storing a sound signal processing program.

BACKGROUND

Microphone array apparatuses of the related art operating in environments where sounds come in from various directions detect and reduce only noise produced by winds hitting microphones.

When a wind blows against a microphone, a diaphragm vibrates significantly, thus producing wind noise. Here, when plural microphones are present, the plural microphones vary from each other in the motion of the diaphragm produced by the wind hitting the microphones, and such variations occur due to various conditions such as individual differences between the microphones, wind pressure, wind direction, and the installed positions of the microphones. Therefore known is a microphone array apparatus that calculates a correlation between input signals from plural microphones, and, when the correlation is small, determines that noise is produced by wind hitting, and performs a reduction process of the microphone signals (for example, Japanese Laid-open Patent Publication No. 2008-263483).

SUMMARY

According to an aspect of the invention, a microphone array apparatus includes: an acquisition unit configured to acquire samples from a sound signal inputted from each of a plurality of microphones, at predetermined time intervals; an operation unit configured to calculate a value based on volumes of the sound signal possessed by a plurality of the samples for each of the sound signals inputted from the plurality of microphones; a correlation coefficient calculator configured to calculate a coefficient of correlation between the sound signals, on the basis of the values calculated for the respective sound signals; and a gain calculator configured to calculate reduction gain for the sound signals inputted from the plurality of microphones, on the basis of the coefficient of correlation.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

The related art can detect wind hitting noise with high accuracy from signals with a low level of sound produced by vibrations due to a factor other than the wind hitting. Meanwhile, even in environments where sound waves of voices or any types of sounds come in from various directions, the correlation between input signals takes a small value in some cases depending on the incoming directions of the sounds, as in the case of the correlation under the wind hitting. Therefore, the related art presents problems of deterioration in the accuracy of detection of the wind hitting noise, and also deterioration in the accuracy of reduction of the wind hitting noise, based on the accuracy of detection. For example, when receiving plural incoming sounds from a direction in which microphones are arranged side by side, a microphone array apparatus of the related art determines that a correlation between the plural incoming sounds is small, and excessively reduces the incoming sounds.

Technology disclosed in the embodiments suppresses excessive reduction of a target sound in the technology of performing a reduction process of sound signals based on a correlation between input signals from plural microphones.

The embodiments will be described in detail below.

Figure 1:
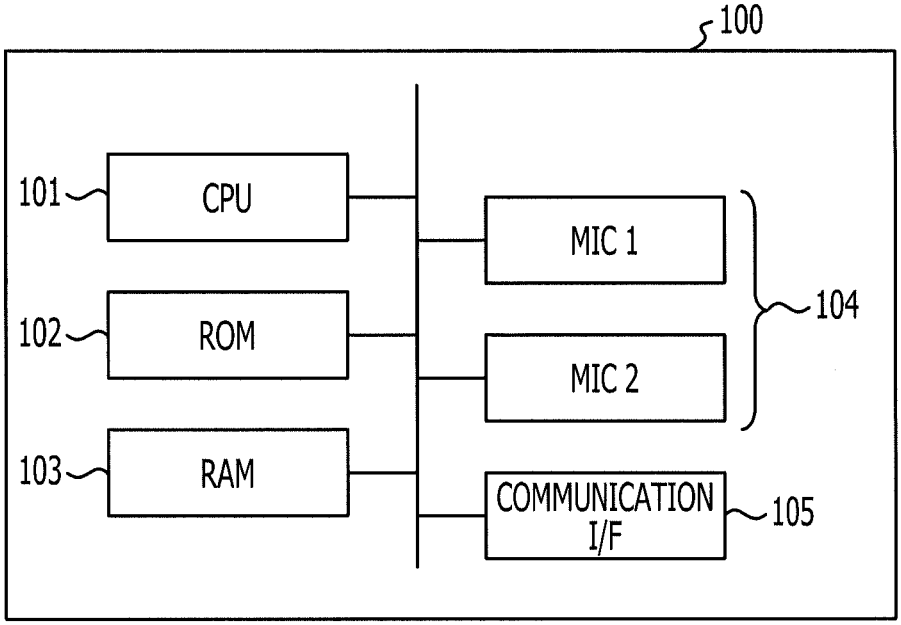
FIG. 1 is a diagram illustrating an example of configuration of a microphone array apparatus.

FIG. 1 is an example of a block diagram illustrating a hardware configuration of a microphone array apparatus according to a first embodiment. A microphone array apparatus 100 includes, for example, central processing unit (CPU) 101, read only memory (ROM) 102, random access memory (RAM) 103, a microphone array 104, and a communication interface (I/F) 105.

The microphone array 104 includes at least two microphones. Here, description will be given taking an instance where two microphones MIC1 and MIC2 are included.

The ROM 102 stores various control programs involved in various controls to be described later which the microphone array apparatus 100 performs. The various control programs include, for example, a program to execute a noise reduction process routine to be described later. Also, the ROM 102 stores a constant α to be described later, and the like.

The RAM 103 temporarily stores the various control programs contained in the ROM 102, sound signals acquired by the microphone array 104, and the like. Also, the RAM 103 temporarily stores information such as various flags according to execution of the various control programs.

The CPU 101 loads the various control programs stored in the ROM 102 into the RAM 103 thereby to perform the various controls.

The communication I/F 105 provides a connection of the microphone array apparatus 100 to an external network or the like, under control of the CPU 101. For example, the microphone array apparatus 100 is connected via the communication I/F 105 to a speech recognition apparatus or the like, and outputs a sound signal processed by the microphone array apparatus 100 to the speech recognition apparatus.

Figure 2:
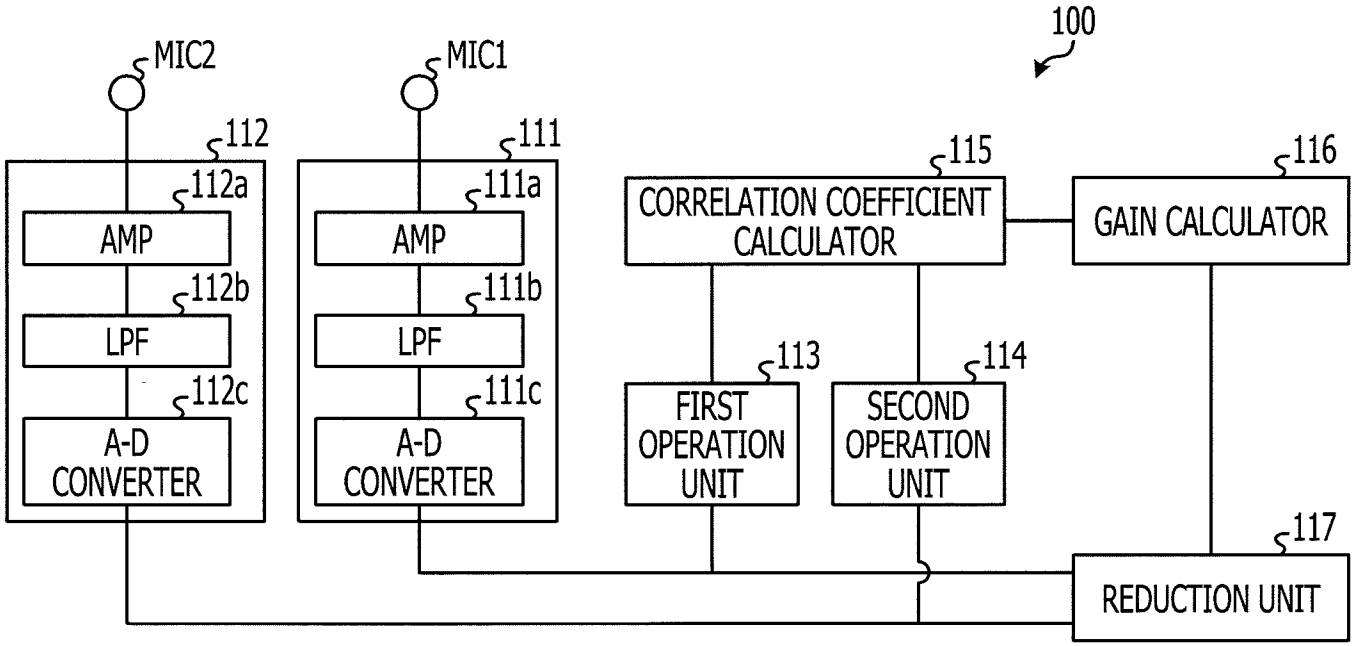
FIG. 2 is a functional block diagram of a microphone array apparatus according to a first embodiment.

FIG. 2 is an example of a functional block diagram of the microphone array apparatus 100 according to the first embodiment.

Processes by functional units of the microphone array apparatus 100 are executed by the CPU 101, the programs stored in the ROM 102, the microphone array 104 and the like cooperating with one another.

The functional units of the microphone array apparatus 100 include, for example, a first acquisition unit 111, a second acquisition unit 112, a first operation unit 113, a second operation unit 114, a correlation coefficient calculator 115, a gain calculator 116, and a reduction unit 117. The functional units will be described below.

The microphone MIC1 acquires a sound, converts the sound into an analog signal, and inputs the analog signal to the first acquisition unit 111. The first acquisition unit 111 includes an amplifier (AMP) 111*a*, a low pass filter (LPF) 111*b*, and an analog-digital (A-D) converter 111*c*. The first acquisition unit 111 subjects the sound containing a target sound and noise, inputted from the microphone MIC1, to a sampling process thereby to generate a sample of a sound signal.

The AMP 111*a* amplifies the analog signal inputted from the microphone MIC1, and inputs the amplified signal to the LPF 111*b*.

The LPF 111*b* as the low pass filter passes an output from the AMP 111*a*, a signal of lower frequencies, using a cutoff frequency fc, for example. Although the low pass filter is here used alone, the microphone array apparatus may use the low pass filter in combination with a band pass filter or a high pass filter.

The A-D converter 111*c* samples an output from the LPF Mb at a sampling frequency fs at predetermined time intervals. Incidentally, the predetermined time interval is called a sampling period. Then, the A-D converter 111*c* converts an analog signal into a digital signal, and outputs a sample Lin(t) of a sound signal at the sampling periods.

The microphone MIC2 acquires a sound, converts the sound into an analog signal, and inputs the analog signal to the second acquisition unit 112. The second acquisition unit 112 includes an AMP 112*a*, an LPF 112*b*, and an A-D converter 112*c*. The second acquisition unit 112 subjects the sound containing target sound and noise, inputted from the microphone MIC2, to a sampling process thereby to generate a sample of a sound signal. Since processes that are performed by the AMP 112*a*, the LPF 112*b*, and the A-D converter 112*c* are the same as those performed in the first acquisition unit 111, description of the processes will be omitted. The second acquisition unit 112 outputs a sample Rin(t) of a sound signal as a digital signal at the sampling periods.

Description will now be given with regard to the principle of the embodiment. The conventional microphone array estimates that wind noise is produced, when a correlation between sound signals inputted from microphones is small. Then, when it is estimated that the wind noise is produced, the conventional microphone array performs reduction of the wind noise. However, even when a target sound such as a voice, instead of undesired wind noise, is inputted to each microphone, the correlation between the sound signals outputted by the microphones is small in some cases depending on the position of a source of the target sound.

The microphone array apparatus according to the embodiment is configured focusing on the fact that a time lag with which a target sound such as a voice arrives at the microphones (hereinafter also simply referred to as a "target sound arrival time lag") is smaller than a lag that the waveforms obtained by the microphones have therebetween on the time axis due to wind noise (Hereinafter also simply referred to as a "waveform time lag"). The target sound arrival time lag between the microphones is caused by a distance between the microphones. With the typical microphone array apparatus, the target sound arrival time lag corresponds to a sample. The waveform time lag between the microphones due to wind noise is caused by individual differences between the microphones. The waveform time lag often corresponds to the order of a few samples, although being unpredictable since the individual differences vary from one to another of the microphones adopted for the microphone array. Therefore, the microphone array apparatus according to the embodiment determines a correlation between the microphones in units of plural accumulated samples of a sound signal. Accordingly, the microphone array apparatus according to the embodiment can reduce the influence of the target sound arrival time lag upon a decrease in the correlation.

In the embodiment, therefore, the first operation unit 113 calculates power Lpow(t) of a sound signal Lin(t) in accordance with Equation (1), using plural samples Lin(t) containing a previous sample of the sound signal. Here, t denotes sampling number.

$$Lpow(t)=\Sigma_{j=0}Lin(t-j)^2 \quad (1)$$

The order of addition is a real number larger than "the sampling frequency×the distance between the microphones/the sound velocity." Incidentally, the order of addition is a maximum value of j−1. For example, when the sampling frequency is 8 kHz and the distance between the microphones is 4.2 cm, the order of addition is set to 8. Incidentally, the order of addition may be experimentally determined, allowing for the individual differences between the microphones or the like. The power Lpow(t) calculated from Equation (1) is a sum of powers of the plural samples of the sound signal, and is an example of the volume of the sound signal in a unit of processing containing the plural samples.

The second operation unit 114 calculates power Rpow(t) of a sound signal Rin(t) in accordance with Equation (2), using plural samples Rin(t) containing a previous sample of the sound signal.

$$Rpow(t)=\Sigma_{j=0}Rin(t-j)^2 \quad (2)$$

The order of addition is the same as that of Equation (1).

The correlation coefficient calculator 115 calculates a correlation coefficient r(t) for the power of the sound signal Lin(t) and the power of the sound signal Rin(t) in accordance with Equation (3), based on the powers Lpow(t) and Rpow(t) in a predetermined time period. The predetermined time period defines how many units of processing the correlation coefficient is to be calculated for. Incidentally, hereinafter, r(t) is an absolute value unless otherwise specified. In other words, r(t) is a real number between 0 and 1.

$$r(t) = \frac{\sum_{i=0} Lpow(t-i)Rpow(t-i)}{(\sum_{i=0} Lpow(t-i)^2 \sum_{i=0} Rpow(t-i)^2)^{1/2}} \quad (3)$$

The gain calculator 116 estimates that, with the smaller correlation coefficient r(t), wind noise is contained in the plural samples of the sound signal within a processing object. Then, the gain calculator 116 calculates gain g(t) to reduce the noise, in accordance with Equation (4), based on the correlation coefficient r(t).

$$g(t)=\max(r(t),\alpha) \quad (4)$$

"α" is a lower limit value between 0 and 1 inclusive and is a constant. A function max(r(t), α) is the function that returns a larger value of r(t) and α. From Equation (4), when r(t) is larger than α, the gain calculator 116 sets r(t) as g(t). When r(t) is equal to or smaller than α, the gain calculator 116 sets α as g(t). Incidentally, a calculation method for the gain g(t) is not limited to the above. For example, the gain g(t) may be discretely set. In other words, when $a<r(t)\leq b$, g(t) may be set equal to c (g(t)=c), where a, b and c are appropriately set values and are real numbers between 0 and 1.

The reduction unit 117 multiplies the samples Lin(t) and Rin(t) of the sound signals by the gain g(t) calculated by the gain calculator 116, as represented by Equations (5) and (6). The reduction unit 117 determines and outputs noise-reduced sound signals Lout(t) and Rout(t).

$$Lout(t)=g(t)\cdot Lin(t) \quad (5)$$

$$Rout(t)=g(t)\cdot Rin(t) \quad (6)$$

In Equations (5) and (6), the smaller correlation r(t) leads also to the smaller gain g(t). In other words, when wind noise is contained in the sound signal, g(t) becomes small. Therefore, the amount of reduction of the sound signal becomes large, and significant reduction is performed on the sample containing the wind noise. Incidentally, although description has been given assuming that Lin(t), Rin(t) and g(t) are calculated for each sampling number, the embodiment is not so limited. For example, a common gain g(t) may be used for every plural samples. Further, j samples may be used as the plural samples. In other words, the microphone array apparatus performs calculations of Lin(t), Rin(t) and g(t) for every j input samples. Then, the calculated gain g(t) may be used for all the j input samples after the calculations. This configuration enables reducing the amount of calculations.

Here, sound signals reduced by the above-described processing are sound signals caused by noise produced by fluids colliding with the microphones like wind noise, rather than sound signals obtained by detecting sound waves propagating to the microphones MIC1 and MIC2. When winds collide with MIC1 and MIC2, turbulent flows are produced. Here, even if winds with the same wind pressure collide with MIC1 and MIC2 at the same time, the produced turbulent flows vary according to individual differences between MIC1 and MIC2, a difference in installed environment between MIC1 and MIC2, and the like. In other words, the waveforms of the microphones MIC1 and MIC2 detected when the turbulent flows vibrate the diaphragms have a remarkably small correlation therebewteen. Incidentally, the individual differences between the microphones are observed in, for example, the strength of tension of the diaphragms, and surface configuration errors of the microphones.

Meanwhile, sound waves have their waveforms with a correlation except that the sound waves arrive at the microphones with a time lag. The sound waves arrive as plane waves at the microphones, particularly when a distance from a sound source to the microphones is sufficiently great as compared to the distance between the microphones. Therefore, a power or the like is also low in decay, and thus, the waveforms of signals detected by the microphones are similar except that the waveforms have a time lag.

Next, an operational flow of a sound reduction process of the first embodiment will be described.

Figure 3:
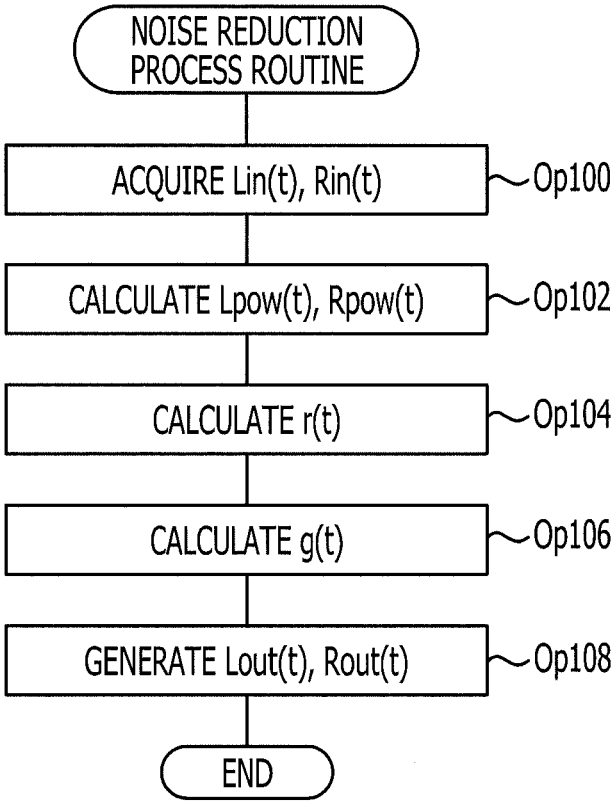
FIG. 3 is a flowchart illustrating the contents of a noise reduction process routine of the microphone array apparatus according to the first embodiment.

The microphones MIC1 and MIC2 of the microphone array apparatus 100 output analog signals of input sounds to the first acquisition unit 111 and the second acquisition unit 112. Then, the first acquisition unit 111 and the second acquisition unit 112 generate samples of sound signals Lin(t) and Rin(t). In the embodiment, each time the first acquisition unit 111 and the second acquisition unit 112 generate the sound signals Lin(t) and Rin(t), the CPU 101 of the microphone array apparatus 100 executes a noise reduction process routine illustrated in FIG. 3.

In operation Op100, the CPU 101 acquires the sound signals Lin(t) and Rin(t) generated by the first acquisition unit 111 and the second acquisition unit 112, and stores the sound signals Lin(t) and Rin(t) in the RAM 103.

Then, in operation Op102, the CPU 101 calculates a power Lpow(t) of the sound signal Lin(t) in accordance with Equation (1), using plural samples Lin(t), Lin(t−1), . . . , Lin(t−N) of the sound signal stored in the RAM 103. Also, the CPU 101 calculates a power Rpow(t) of the sound signal Rin(t) in accordance with Equation (2), using plural samples Rin(t), Rin(t−1), . . . , Rin(t−N) of the sound signal stored in the RAM 103. The CPU 101 stores the calculated power Lpow(t) of the sound signal Lin(t) and the calculated power Rpow(t) of the sound signal Rin(t) in the RAM 103. Here, N is a value based on the order of addition in Equations (1) and (2).

Then, in operation Op104, the CPU 101 acquires the power Rpow(t), Rpow(t−1), . . . , Rpow(t−M) and the power Lpow (t), Lpow(t−1), Lpow(t−M) stored in the RAM 103. The CPU 101 calculates a correlation coefficient r(t) in accordance with Equation (3). Here, M is the order for use in accumulative addition in Equation (3). Then, in operation Op106, the CPU 101 calculates gain g(t) in accordance with Equation (4), using the correlation coefficient r(t) calculated by operation Op104.

In subsequent operation Op108, the CPU 101 generates a sound signal Lout(t) by multiplying the sample Lin(t) of the sound signal acquired by operation Op100 by the gain g(t) calculated by operation Op106. Then, the CPU 101 outputs the sound signal Lout(t). Also, the CPU 101 generates a sound signal Rout(t) by multiplying the sample Rin(t) of the sound signal acquired by operation Op100 by the gain g(t) calculated by operation Op106. Then, the CPU 101 outputs the sound signal Rout(t). Then, the noise reduction process routine is brought to an end.

As described above, the microphone array apparatus 100 according to the first embodiment calculates a sum of powers of plural samples of a sound signal for each of plural microphones. The microphone array apparatus 100 calculates a coefficient of correlation between the sums of the powers of the sound signals received by the microphones. When the correlation coefficient is small, the microphone array apparatus 100 determines that wind noise is produced, and calculates gain to reduce the wind noise, based on the correlation coefficient. Thereby, the microphone array apparatus 100 can reduce the wind noise in the sound signals from the plural microphones, and also reduces excessive reduction of a sound other than the wind noise.

Next, description will be given with regard to a second embodiment. Incidentally, parts having the same configurations as those of the first embodiment are indicated by the same reference numerals, and description of the configurations will be omitted.

The second embodiment is different from the first embodiment in that the microphone array apparatus uses a ratio between the power of the sound signal Lin(t) and the power of the sound signal Rin(t) to calculate gain.

Figure 4:
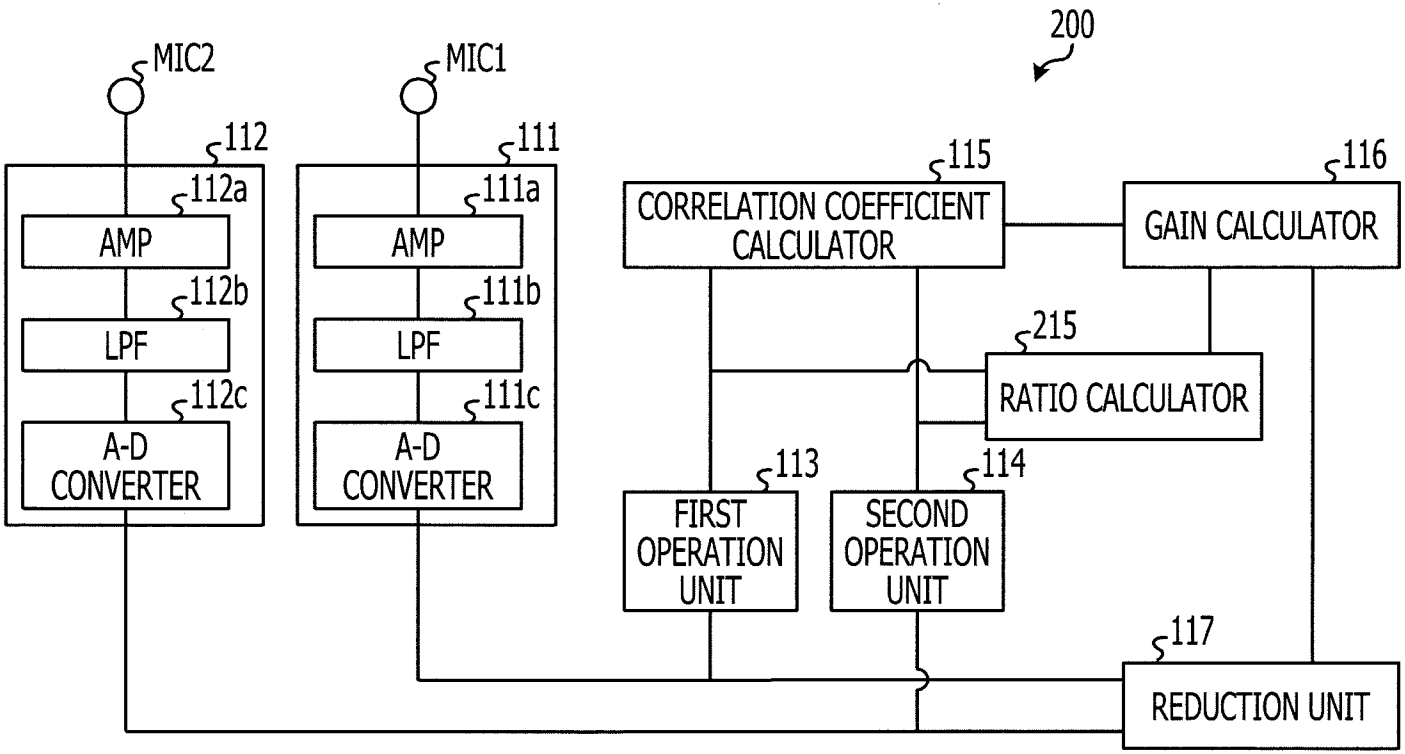
FIG. 4 is a functional block diagram of a microphone array apparatus according to a second embodiment.

As illustrated in FIG. 4, functional units of a microphone array apparatus 200 according to the second embodiment include, for example, a first acquisition unit 111, a second acquisition unit 112, a first operation unit 113, a second operation unit 114, and a correlation coefficient calculator 115. Also, the functional units of the microphone array apparatus 200 include a ratio calculator 215. The ratio calculator 215 may be included in a gain calculator 116.

The ratio calculator 215 calculates a power ratio LR(t) between the power of plural samples containing the sound signal Lin(t) and the power of plural samples containing the sound signal Rin(t) in accordance with Equation (7), based on the calculated power Lpow(t) and power Rpow(t).

$$LR(t)=(Rpow(t)/Lpow(t)/Lpow(t))^{1/2} \quad (7)$$

The gain calculator 116 calculates gain $g(t_i)$ based on the correlation coefficient r(t) and the power ratio LR(t), as given below.

When LR(t)<1, that is, when Lpow(t) is more than Rpow (t), the gain calculator 116 calculates gain Lg(t) and Rg(t) for the sound signals Lin(t) and Rin(t) in accordance with Equations (8) and (9). Incidentally, when LR(t)<1, Rg(t) may be set equal to 1. In other words, the microphone array apparatus outputs Rin(t) as Rout(t).

$$Lg(t)=\max(r(t)\cdot LR(t),\alpha) \quad (8)$$

$$Rg(t)=\max(r(t),\alpha) \quad (9)$$

"α" is a lower limit value between 0 and 1 inclusive and is a constant. Incidentally, the power ratio LR(t) is an example of a correction coefficient to provide a match between plural microphones in the volumes of input signals from the microphones.

When LR(t)>1, that is, when Rpow(t) is more than Lpow (t), the gain calculator 116 calculates gain Lg(t) and Rg(t) for the sound signals Lin(t) and Rin(t) in accordance with Equations (10) and (11).

$$Lg(t)=\max(r(t),\alpha) \quad (10)$$

$$Rg(t)=\max(r(t)/LR(t),\alpha) \quad (11)$$

Incidentally, 1/LR(t) is an example of the correction coefficient.

The reduction unit 117 determines sound signals Lout(t) and Rout(t) by multiplying the sound signals Lin(t) and Rin(t) by the gain Lg(t) and Rg(t) calculated by the gain calculator 116, as represented by Equations (12) and (13), and outputs the sound signals Lout(t) and Rout(t).

$$Lout(t)=Lg(t)\cdot Lin(t) \quad (12)$$

$$Rout(t)=Rg(t)\cdot Rin(t) \quad (13)$$

Next, an operational flow of a sound reduction process of the second embodiment will be described.

Figure 5:
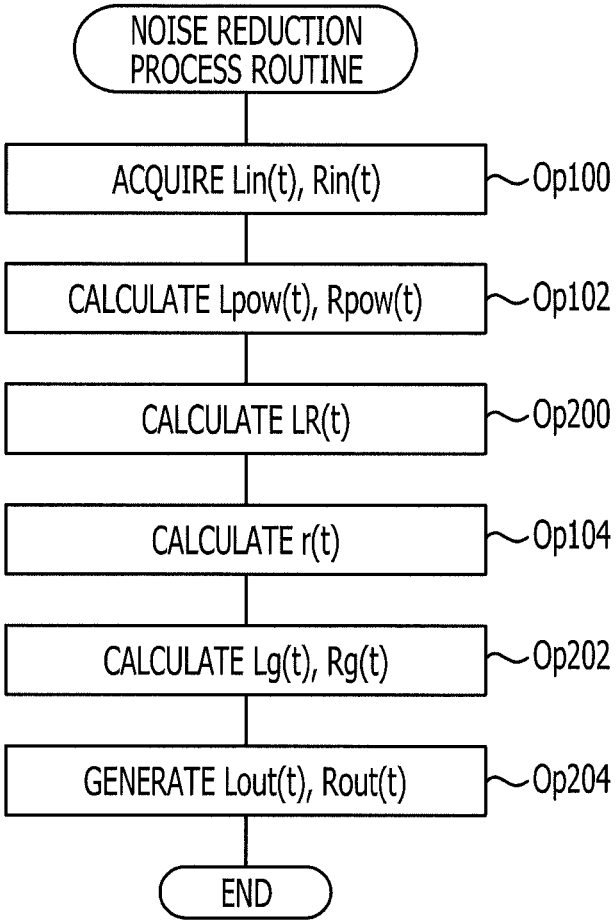
FIG. 5 is a flowchart illustrating the contents of a noise reduction process routine of the microphone array apparatus according to the second embodiment.

The microphones MIC1 and MIC2 of the microphone array apparatus 200 output analog signals of input sounds, and the first acquisition unit 111 and the second acquisition unit 112 generate samples Lin(t) and Rin(t) of sound signals. Each time the first acquisition unit 111 and the second acquisition unit 112 generate the samples Lin(t) and Rin(t) of the sound signals, the CPU 101 of the microphone array apparatus 200 executes a noise reduction process routine illustrated in FIG. 5. Incidentally, the same operations as those of the first embodiment are indicated by the same reference numerals, and detailed description of the operations will be omitted.

In operation Op100, the CPU 101 acquires the samples Lin(t) and Rin(t) of the sound signals generated by the first acquisition unit 111 and the second acquisition unit 112, and stores the samples Lin(t) and Rin(t) in the RAM 103.

Then, in operation Op102, the CPU 101 calculates a power Lpow(t) of the sound signal Lin(t), and stores the power Lpow(t) in the RAM 103. Also, the CPU 101 calculates a power Rpow(t) of the sound signal Rin(t), and stores the power Rpow(t) in the RAM 103.

Then, in operation Op200, the CPU 101 calculates a power ratio LR(t) in accordance with Equation (7), based on the power Rpow(t) and the power Lpow(t) calculated by operation Op102.

Then, in operation Op104, the CPU 101 calculates a correlation coefficient r(t). Incidentally, Op200 and Op104 are performed irrespective of order. In subsequent operation Op202, the CPU 101 calculates gain Lg(t) and Rg(t) in accordance with Equations (8) and (9), using the power ratio LR(t) calculated by operation Op200 and the correlation coefficient r(t) calculated by operation Op104. Alternatively, the CPU 101 calculates the gain Lg(t) and Rg(t) in accordance with Equations (10) and (11).

In subsequent operation Op204, the CPU 101 determines a sound signal Lout(t) by multiplying the sample Lin(t) of the sound signal acquired by operation Op100 by the gain Lg(t) calculated by operation Op202, and outputs the sound signal Lout(t). Also, the CPU 101 determines a sound signal Rout(t) by multiplying the sample Rin(t) of the sound signal acquired by operation Op100 by the gain Rg(t) calculated by operation Op202 and outputs the sound signal Rout(t), and brings the noise reduction process routine to an end.

As described above, the microphone array apparatus 200 according to the second embodiment calculates a sum of powers of plural samples of a sound signal for each of plural microphones, and calculates a correlation coefficient. Further, the microphone array apparatus 200 calculates a power ratio between input sound signals of the plural microphones. When wind noise is contained in the sound signal, the sound signal containing the wind noise, of the sound signals outputted by the plural microphones, is high in power. Therefore, reduction for the sound signal containing the wind noise has to be performed in larger amounts than reduction for the sound signal containing no wind noise. Therefore, the microphone array apparatus 200 calculates gain to determine the amount of reduction, using the correlation coefficient and the power ratio. Then, the microphone array apparatus 200 sets gain having a smaller value for the signal having a higher power, of the sound signals outputted by the plural microphones, as represented by Equations (8) to (10). The microphone array apparatus 200 can reduce the wind noise, allowing for the power ratio between the sound signals of the plural microphones.

Incidentally, in the above-described embodiments, description has been given with regard to an instance where the microphone array apparatus calculates the sum of the powers of the plural samples of the sound signal for each of the plural microphones; however, the embodiments are not so limited. As described with reference to a fourth embodiment to be discussed later, the microphone array apparatus may calculate an average of the powers of the plural samples of the sound signal for each of the plural microphones.

Next, description will be given with regard to a third embodiment. Incidentally, parts having the same configurations as those of the first or second embodiment are indicated by the same reference numerals, and description of the configurations will be omitted.

In the third embodiment, the microphone array apparatus performs a Fourier transform on sound signals Lin(t) and Rin(t). Then, the third embodiment is different from the first or second embodiment in that the microphone array apparatus performs a noise reduction process for each frequency component.

Figure 6:
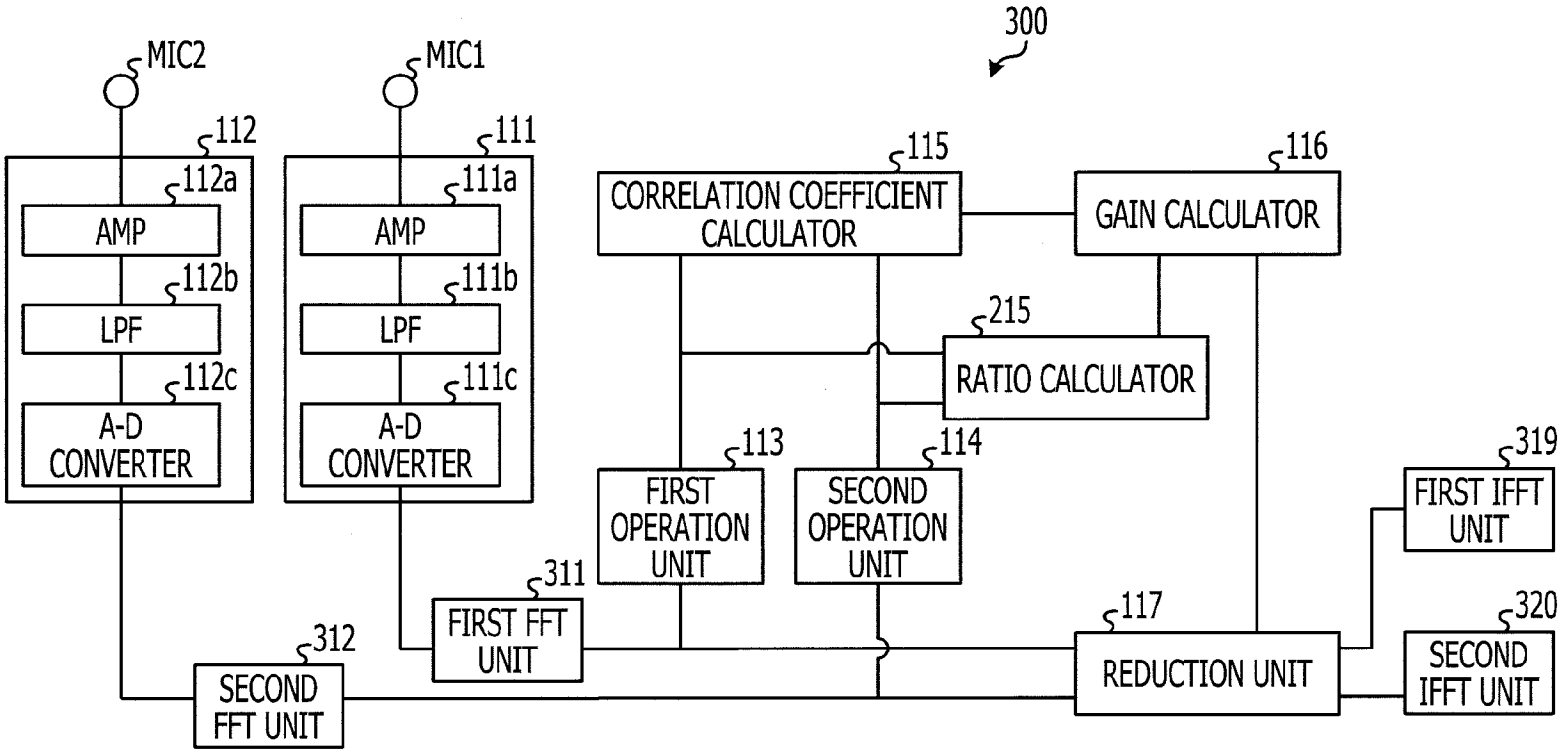
FIG. 6 is a functional block diagram of a microphone array apparatus according to a third embodiment.

As illustrated in FIG. 6, functional units of a microphone array apparatus 300 according to the third embodiment include, for example, a first acquisition unit 111, a second acquisition unit 112, a first fast Fourier transform unit 311, and a second fast Fourier transform unit 312. Also, the functional units of the microphone array apparatus 300 include a first operation unit 113, a second operation unit 114, a correlation coefficient calculator 115, a ratio calculator 215, a gain calculator 116, and a reduction unit 117. Also, the functional units of the microphone array apparatus 300 include a first inverse fast Fourier transform unit 319, and a second inverse fast Fourier transform unit 320. Incidentally, the first fast Fourier transform unit 311 and the second fast Fourier transform unit 312 are examples of the transform unit. Incidentally, in FIG. 6, a fast Fourier transform is represented as FFT. Further, in FIG. 6, an inverse fast Fourier transform is represented as IFFT.

The first fast Fourier transform unit 311 performs a fast Fourier transform on a sample Lin(t) of a sound signal in a time period corresponding to an analysis frame unit thereby to calculate frequency components LIN(i,f) of the sound signal Lin(t) for each analysis frame unit. Here, i denotes analysis frame number of the sound signal, and f denotes frequency sampling number.

The second fast Fourier transform unit 312 performs a fast Fourier transform on a sample Rin(t) of a sound signal in a time period corresponding to an analysis frame unit thereby to calculate frequency components RIN(i,f) of the sound signal Rin(t) for each analysis frame unit.

The first operation unit 113 calculates a power LPOW(i,f) of the frequency component LIN(i,f) for each frequency component f for each analysis frame i, in accordance with Equation (14), using plural values LIN(i,f) of the frequency component.

$$LPOW(i,f)=\Sigma_{j=0}LIN(i-j,f)^2 \tag{14}$$

The order of addition is at least a few times "the sampling frequency×the distance between the microphones/(the sound velocity×the length of the analysis frame)." The order of addition is a maximum value of j−1. Incidentally, the power LPOW(i,f) calculated from Equation (14) is a sum of powers of the frequency component of plural analysis frames. Then, the power LPOW(i,f) is an example of the volume of the sound signal for each unit of processing and for each frequency component. Incidentally, in the embodiment, the unit of processing refers to plural analysis frames, which are the analysis frames for the order of addition.

The second operation unit 114 calculates a power RPOW (i,f) of the frequency component RIN(i,f) for each frequency component f for each analysis frame i, in accordance with Equation (15), using plural values RIN(i,f) of the frequency component.

$$RPOW(i,f)=\Sigma_{j=0}RIN(i-j,f)^2 \tag{15}$$

The order of addition is the same as that of Equation (14).

The correlation coefficient calculator 115 calculates a correlation coefficient R(i,f) for each frequency component f for each analysis frame i in accordance with Equation (16), based on the powers LPOW(i,f) and RPOW(i,f) in a predetermined time period. The predetermined time period defines how many units of processing the correlation coefficient is to be calculated for.

$$R(i,f)=\frac{\sum_{k=0}LPOW(i-k,f)RPOW(i-k,f)}{(\sum_{k=0}LPOW(i-k,f)^2\sum_{k=0}RPOW(i-k,j)^2)^{1/2}} \tag{16}$$

In Equation (16), the correlation coefficient R(i,f) for the power of the frequency component LIN(i,f) and the power of the frequency component RIN(i,f) is calculated.

The ratio calculator 215 calculates a power ratio LR(i,f) for each frequency component f for each analysis frame i in accordance with Equation (17), based on the calculated a power LPOW(i,f) and a power RPOW(i,f).

$$LR(i,f)=(RPOW(i,f)/LPOW(i,f))^{1/2} \tag{17}$$

In Equation (17), the power ratio LR(i,f) between the power of the frequency component LIN(i,f) and the power of the frequency component RIN(i,f) is calculated.

The gain calculator 116 calculates gain LG(i,f) and RG(i,f) for the frequency components LIN(i,f) and RIN(i,f) for each frequency component f for each analysis frame i, based on the correlation coefficient R(i,f) and the power ratio LR(i,f), as given below.

When LR(i,f)<1, that is, when LPOW(i,f) is more than RPOW(i,f), the gain calculator 116 calculates the gain LG(i,f) and RG(i,f) in accordance with Equations (18) and (19).

$$LG(i,f)=\max(R(i,f)\cdot LR(i,f),\alpha) \tag{18}$$

$$RG(i,f)=\max(R(i,f),\alpha) \tag{19}$$

"α" is a lower limit value between 0 and 1 inclusive and is a constant.

When LR(i,f)>1, that is, when RPOW(i,f) is more than LPOW(i,f), the gain calculator 116 calculates the gain LG(i,f) and RG(i,f) in accordance with Equations (20) and (21).

$$LG(i,f)=\max(R(i,f),\alpha) \tag{20}$$

$$RG(i,f)=\max(R(i,f)/LR(i,f),\alpha) \tag{21}$$

The reduction unit 117 determines noise-reduced frequency components LOUT(i,f) and ROUT(i,f) for each frequency component f for each analysis frame i, as represented by Equations (22) and (23).

$$LOUT(i,f)=LG(i,f)\cdot LIN(i,f) \tag{22}$$

$$ROUT(i,f)=RG(i,f)\cdot RIN(i,f) \tag{23}$$

In Equations (22) and (23), the gain LG(i,f) and RG(i,f) calculated by the gain calculator 116 are multiplied by the frequency components LIN(i,f) and RIN(i,f).

The first inverse fast Fourier transform unit 319 determines a sound signal Lout(t) by performing an inverse fast Fourier transform on each frequency component LOUT(i,f) for each analysis frame i, and outputs the sound signal Lout(t).

The second inverse fast Fourier transform unit 320 determines a sound signal Rout(t) by performing an inverse fast Fourier transform on each frequency component ROUT(i,f) for each analysis frame i, and outputs the sound signal Rout (t).

Next, an operational flow of a noise reduction process of the third embodiment will be described.

Figure 7:
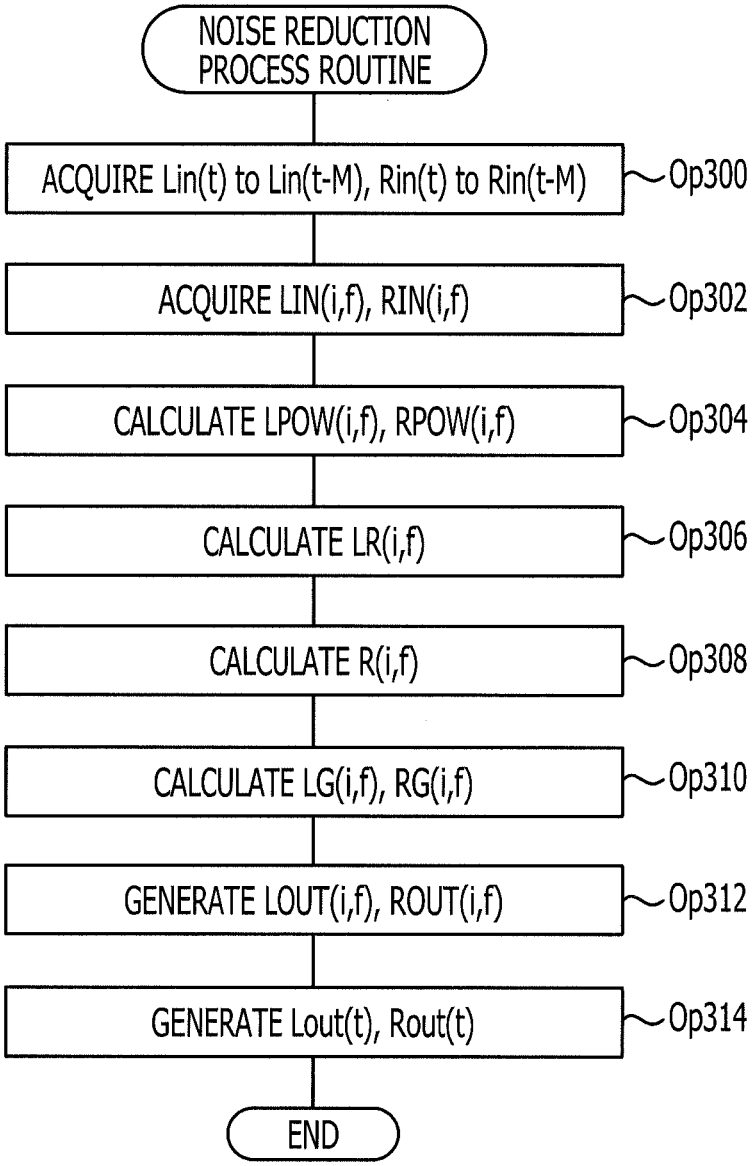
FIG. 7 is a flowchart illustrating the contents of a noise reduction process routine of the microphone array apparatus according to the third embodiment.

The microphones MIC1 and MIC2 of the microphone array apparatus 300 output analog signals of input sounds, and the first acquisition unit 111 and the second acquisition unit 112 generate samples Lin(t) and Rin(t) of sound signals. Each time the first acquisition unit 111 and the second acquisition unit 112 generate the samples Lin(t) and Rin(t) of the sound signals, the CPU 101 of the microphone array apparatus 300 executes a noise reduction process routine illustrated in FIG. 7.

First, in operation Op300, the CPU 101 acquires the samples Lin($t_i$) to Lin(t−M) and Rin(t) to Rin($t_i$−M) of the sound signals generated by the first acquisition unit 111 and the second acquisition unit 112. Here, the number of samples of the sound signal in the time period corresponding to the analysis frame unit is set to M+1.

Then, in operation Op302, the CPU 101 calculates each frequency component LIN(i,f) by performing a fast Fourier transform on the samples Lin($t_i$) to Lin($t_i$−M) of the sound signal acquired by operation Op300, and stores the frequency component LIN(i,f) in the RAM 103. Here, i denotes the number of the analysis frame in which the fast Fourier transform is performed by operation Op302. Also, the CPU 101 calculates each frequency component RIN(i,f) by performing a fast Fourier transform on the samples Rin($t_i$) to Rin($t_i$−M) of the sound signal acquired by operation Op300, and stores the frequency component RIN(i,f) in the RAM 103.

In subsequent operation Op304, the CPU 101 reads out the frequency components LIN(i,f), LIN(i−1,f), . . . , LIN(i−N,f) stored in the RAM 103 for each frequency component f. Then, the CPU 101 calculates the power LPOW(i,f) of the frequency component LIN(i,f) in accordance with Equation (14). Also, the CPU 101 reads out the frequency components RIN(i,f), RIN(i−1,f), . . . , RIN(i−N,f) stored in the RAM 103 for each frequency component f. Then, the CPU 101 calculates the power RPOW(i,f) of the frequency component RIN (i,f) in accordance with Equation (15). The CPU 101 stores the calculated power LPOW(i,f) of the frequency component LIN(i,f) and the calculated power RPOW(i,f) of the frequency component RIN(i,f) in the RAM 103. Here, N is a value based on the order of addition in Equations (14) and (15).

Then, in operation Op306, the CPU 101 calculates the power ratio LR(i,f) for each frequency component f in accordance with Equation (17), based on the power RPOW(i,f) and the power LPOW(i,f) calculated by operation Op304.

Then, in operation Op308, the CPU 101 acquires the power RPOW(i,f), RPOW(i−1,f), . . . , RPOW(i−L,f) stored in the RAM 103 for each frequency component f. Also, the CPU 101 acquires the power LPOW(i,f), LPOW(i−1,f), . . . , LPOW(i-L,f) stored in the RAM 103 for each frequency component f. The CPU 101 calculates the correlation coefficient R(i,f) in accordance with Equation (16). Here, L is a value based on the order of addition in Equation (16). Incidentally, Op306 and Op308 are performed irrespective of order.

In subsequent operation Op310, the CPU 101 calculates the gain LG(i,f) and RG(i,f) for each frequency component f in accordance with Equations (18) and (19), using the power ratio LR(i,f) and the correlation coefficient R(i,f) calculated by the above-described operations. Alternatively, the CPU 101 calculates the gain LG(i,f) and RG(i,f) for each frequency component f in accordance with Equations (20) and (21).

Then, in operation Op312, the CPU 101 determines the frequency component LOUT(i,f) for each frequency component f by multiplying the frequency component LIN(i,f) calculated by operation Op302 by the gain LG(i,f) calculated by operation Op310. Also, the CPU 101 determines the frequency component ROUT(i,f) for each frequency component f by multiplying the frequency component RIN(i,f) calculated by operation Op306 by the gain RG(i,f) calculated by operation Op310.

In subsequent operation Op314, the CPU 101 determines a sample Lout($t_i$) of the sound signal by performing an inverse fast Fourier transform on LOUT(i,f) of each frequency component f determined by operation Op312, and outputs the sample Lout($t_i$). Also, the CPU 101 determines a sample Rout($t_i$) of the sound signal by performing an inverse fast Fourier transform on ROUT(i,f) of each frequency component f determined by operation Op312 and outputs the sample Rout($t_i$), and brings the noise reduction process routine to an end.

As described above, the microphone array apparatus 300 according to the third embodiment calculates a sum of powers of frequency components in plural analysis frames for each frequency component of a sound signal for each of plural microphones, and calculates a correlation coefficient. When the correlation coefficient is small, the microphone array apparatus 300 determines that wind noise is produced, and calculates gain to reduce the noise, based on the correlation coefficient, for each frequency component. Thereby, the microphone array apparatus 300 can reduce the wind noise in the sound signals from the plural microphones for each frequency component, and also can reduce reduction of a sound other than the wind noise. For example, it is known that the wind noise is likely to converge on a low-frequency range, and therefore, the microphone array apparatus 300 performs processing for each frequency component thereby to enable reducing the wind noise with higher accuracy.

Incidentally, in the above-described embodiment, description has been given with regard to an instance where the microphone array apparatus 300 calculates the sum of the powers of the frequency components of the sound signal in the plural analysis frames for each of the plural microphones; however, the embodiment is not so limited. The microphone array apparatus may calculate an average of the powers of the frequency components of the sound signal in the plural analysis frames for each of the plural microphones.

Next, description will be given with regard to a fourth embodiment. Incidentally, a configuration of a microphone array apparatus according to the fourth embodiment is the same as that of the first embodiment, and therefore, the same parts are indicated by the same reference numerals and description of the configuration will be omitted.

The fourth embodiment is different from the first embodiment in a calculation method for a power of a sound signal for each unit of processing.

In the fourth embodiment, the first operation unit 113 calculates a power Lpow($t_i$) of a sound signal Lin($t_i$) in accordance with Equation (24), using plural samples Lin(t) of the sound signal containing a previous sample.

$$Lpow(t)=\gamma Lpow(t-1)+(1-\gamma)Lin(t)^2 \tag{24}$$

"t" denotes sampling number, and γ is a constant between 0 inclusive and 1 exclusive and is determined by the extent to which γ is affected by the influence of the past. For example, γ is equal to $0.01^{1/n}$ ($\gamma=0.01^{1/n}$), assuming that the degree of influence of the past n samples is −20 dB (or a power ratio of 0.01) that has little influence. The power Lpow($t_i$) calculated from Equation (24) is a weighted average of powers of the plural samples of the sound signal, and is an example of the volume of the sound signal in a unit of processing containing the plural samples.

The second operation unit 114 calculates a power Rpow(t) of a sound signal $Rin(t_i)$ in accordance with Equation (25), using plural samples Rin(t) of the sound signal containing a previous sample.

$$Rpow(t)=\gamma Rpow(t-1)+(1-\gamma)Rin(t)^2 \quad (25)$$

Incidentally, other configurations and advantageous effects of the microphone array apparatus according to the fourth embodiment are the same as those of the first embodiment, and therefore, description thereof will be omitted.

As described above, the microphone array apparatus according to the fourth embodiment calculates a weighted average of powers of plural samples of a sound signal for each of plural microphones, and calculates a correlation coefficient. When the correlation coefficient is small, the microphone array apparatus determines that wind noise is produced, and calculates gain to reduce the noise, based on the correlation coefficient. Thereby, the microphone array apparatus can reduce the wind noise in the sound signals from the plural microphones, and also can reduce reduction of a sound other than the wind noise. The use of the weighted average enables reducing the amount of memory used, as compared to calculations represented by Equations (1) and (2). Also, the use of the weighted average enables giving priority to a value close to the most recent sample or frame, thus calculating the more appropriate gain.

Next, description will be given with regard to a fifth embodiment. Incidentally, parts having the same configurations as those of the first embodiment are indicated by the same reference numerals, and description of the configurations will be omitted.

The fifth embodiment is different from the first embodiment in that the microphone array apparatus calculates an average of absolute values of amplitudes of sound signals $Lin(t_i)$ and $Rin(t_i)$, and determines a correlation between the absolute values of the amplitudes.

Figure 8:
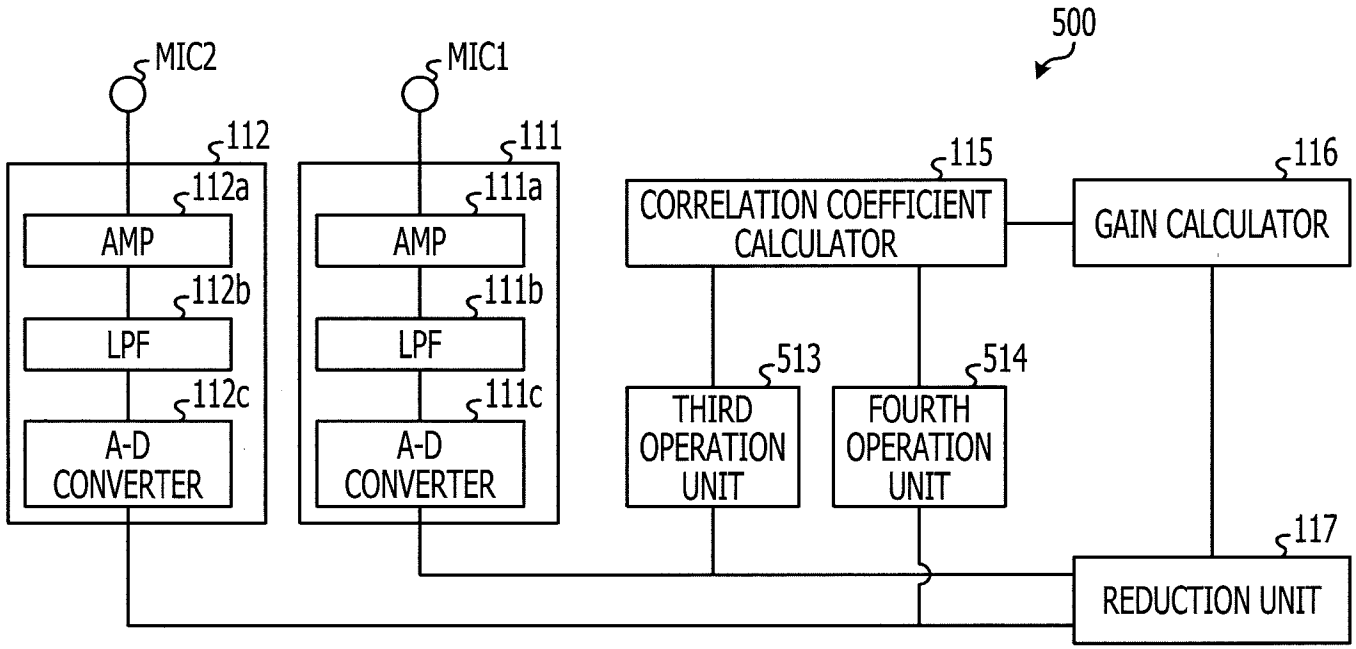
FIG. 8 is a functional block diagram of a microphone array apparatus according to a fifth embodiment.

As illustrated in FIG. 8, functional units of a microphone array apparatus 500 according to the fifth embodiment include, for example, a first acquisition unit 111, a second acquisition unit 112, a third operation unit 513, a fourth operation unit 514, and a correlation coefficient calculator 115. Also, the functional units of the microphone array apparatus 500 include a gain calculator 116, and a reduction unit 117.

The third operation unit 513 calculates an average Lamp(t) of absolute values of amplitudes of a sound signal Lin(t) in accordance with Equation (26), using plural samples Lin(t) of the sound signal containing a previous sample.

$$Lamp(t)=\gamma Lamp(t-1)+(1-\gamma)|Lin(t)| \quad (26)$$

"t" denotes sampling number, and γ is a constant between 0 inclusive and 1 exclusive and is determined by the extent to which γ is affected by the influence of the past. For example, γ is equal to $0.1^{1/n}$ ($\gamma=0.1^{1/n}$), assuming that the degree of influence of the past n samples is −20 dB (or an amplitude ratio of 0.1) that has little influence. The average Lamp(t) of the absolute values of the amplitudes calculated from Equation (26) is an average of absolute values of amplitudes of the plural samples of the sound signal, and is an example of the volume of the sound signal in a unit of processing containing the plural samples.

The fourth operation unit 514 calculates an average Ramp (t) of absolute values of amplitudes of a sound signal Rin(t) in accordance with Equation (27), using plural samples Rin(t) of the sound signal containing a previous sample.

$$Ramp(t)=\gamma Ramp(t-1)+(1-\gamma)|Rin(t)| \quad (27)$$

The correlation coefficient calculator 115 calculates a correlation coefficient r(t) for the average of the absolute values of the amplitudes of the sound signal Lin(t) and the average of the absolute values of the amplitudes of the sound signal Rin(t) in accordance with Equation (28), based on the averages Lamp(t) and Ramp(t) of the absolute values of the amplitudes in a predetermined time period.

$$r(t)=\frac{\sum_{i=0} Lamp(t-i)Ramp(t-i)}{(\sum_{i=0} Lamp(t-i)^2 \sum_{i=0} Ramp(t-i)^2)^{1/2}} \quad (28)$$

Next, advantageous effects of the fifth embodiment will be described.

Figure 9:
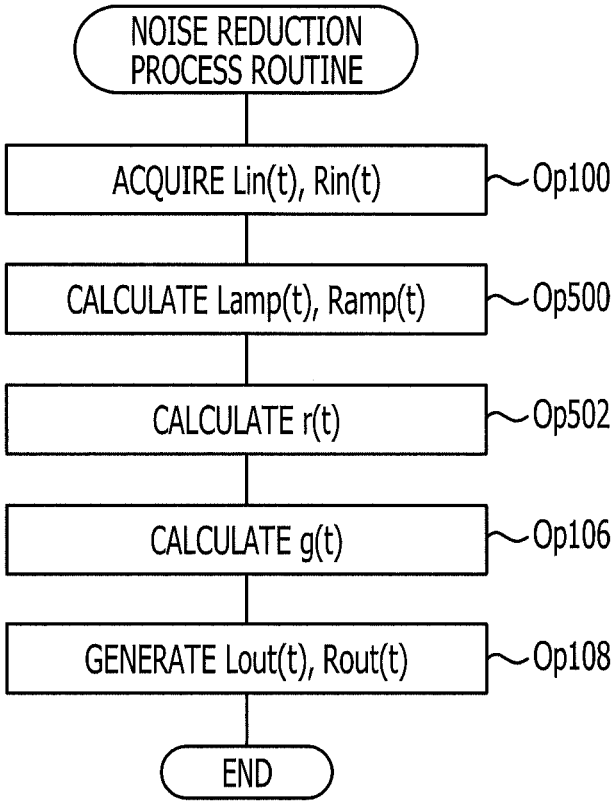
FIG. 9 is a flowchart illustrating the contents of a noise reduction process routine of the microphone array apparatus according to the fifth embodiment.

The microphones MIC1 and MIC2 of the microphone array apparatus 500 output analog signals of input sounds, and the first acquisition unit 111 and the second acquisition unit 112 generate samples Lin(t) and Rin(t) of sound signals. Each time the first acquisition unit 111 and the second acquisition unit 112 generate the samples of the sound signals Lin(t) and Rin(t), the CPU 101 of the microphone array apparatus 500 executes a noise reduction process routine illustrated in FIG. 9. Incidentally, the same operations as those of the first embodiment are indicated by the same reference numerals, and detailed description of the operations will be omitted.

First, in operation Op100, the CPU 101 acquires the samples Lin(t) and Rin(t) of the sound signals generated by the first acquisition unit 111 and the second acquisition unit 112, and stores the samples Lin(t) and Rin(t) in the RAM 103.

Then, in operation Op500, the CPU 101 calculates an average Lamp(t) of absolute values of amplitudes of the sound signal Lin(t) in accordance with Equation (26), using plural samples Lin(t), Lin(t−1), . . . of the sound signal stored in the RAM 103. Also, the CPU 101 calculates an average Ramp(t) of absolute values of amplitudes of the sound signal Rin(t) in accordance with Equation (27), using plural samples Rin(t), Rin(t−1), . . . of the sound signal stored in the RAM 103. The CPU 101 stores the calculated average Lamp(t) of the absolute values of the amplitudes of the sound signal Lin(t) and the calculated average Ramp(t) of the absolute values of the amplitudes of the sound signal Rin(t) in the RAM 103.

Then, in operation Op502, the CPU 101 acquires the averages Ramp(t), Ramp(t−1), . . . , Ramp(t−M) of the absolute values of the amplitudes stored in the RAM 103. Also, the CPU 101 acquires the averages Lamp(t), Lamp(t−1), . . . , Lamp(t−M) of the absolute values of the amplitudes stored in the RAM 103. The CPU 101 calculates a correlation coefficient r(t) in accordance with Equation (28). Here, M is a value based on the order of addition in Equation (28).

Then, in operation Op106, the CPU 101 calculates gain g(t) in accordance with Equation (4), using the correlation coefficient r(t) calculated by operation Op104.

In subsequent operation Op108, the CPU 101 determines a sound signal Lout(t) by multiplying the sample Lin(t) of the sound signal acquired by operation Op100 by the gain g(t) calculated by operation Op106, and outputs the sound signal Lout(t). Also, the CPU 101 determines a sound signal Rout(t) by multiplying the sample Rin(t) of the sound signal acquired by operation Op100 by the gain g(t) calculated by operation Op106 and outputs the sound signal Rout(t), and brings the noise reduction process routine to an end.

As described above, the microphone array apparatus 500 according to the fifth embodiment calculates an average of absolute values of amplitudes of plural samples of a sound signal for each of plural microphones, and calculates a correlation coefficient. When the correlation coefficient is small, the microphone array apparatus 500 determines that wind noise is produced, and calculates gain to reduce the wind noise, based on the correlation coefficient. Thereby, the microphone array apparatus 500 can reduce the wind noise in the sound signals from the plural microphones, and also can reduce reduction of a sound other than the wind noise. The use of the absolute value of the amplitude enables low-cost packaging, as compared to the use of power. For example, for a signal with 16-bit precision, the power uses 32 bits, whereas the absolute value of the amplitude uses only 16 bits.

Incidentally, in the above-described embodiment, the microphone array apparatus may use a ratio between averages of absolute values of amplitudes of sound signals as a correction coefficient to calculate gain, as is the case with the second and third embodiments. Alternatively, the microphone array apparatus may use a correction coefficient according to a difference between averages of absolute values of amplitudes of sound signals to calculate gain.

Also, description has been given taking an instance where the microphone array apparatus calculates an average of absolute values of amplitudes of sound signals; however, the embodiment is not so limited. The microphone array apparatus may calculate a sum of absolute values of amplitudes of sound signals.

Next, description will be given with regard to a sixth embodiment. Incidentally, a configuration of a microphone array apparatus according to the sixth embodiment is the same as that of the first embodiment, and therefore, the same parts are indicated by the same reference numerals and description of the configuration will be omitted.

The sixth embodiment is different from the first embodiment in a calculation method for gain.

In the sixth embodiment, a relationship between a correlation coefficient r(t) and noise reduction gain g(t) according to intervals at which the microphones MIC1 and MIC2 are arranged is set for the gain calculator 116.

Figure 10:
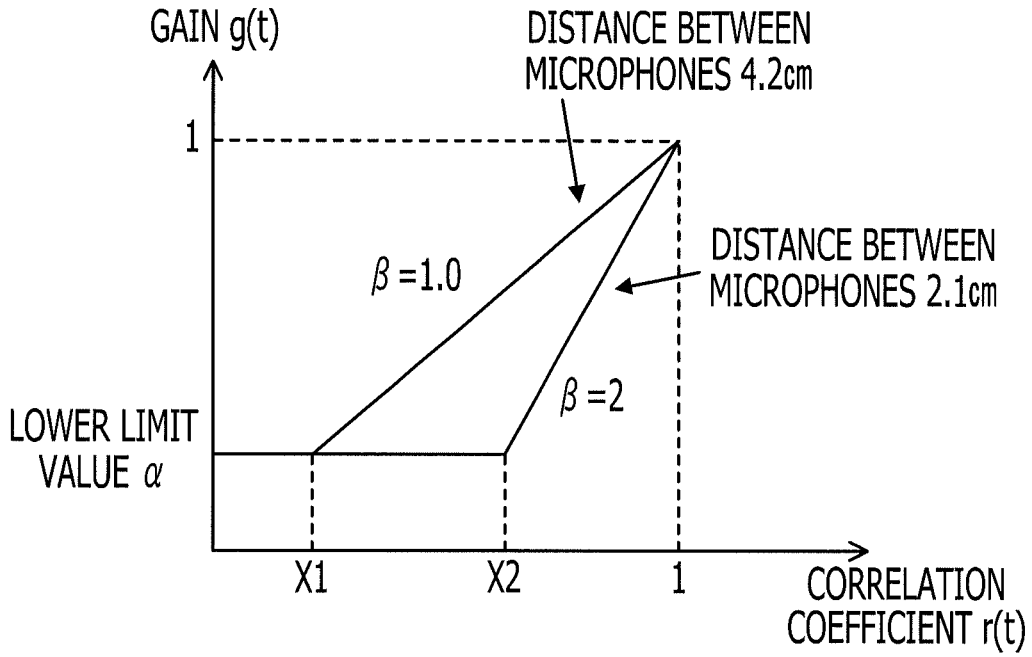
FIG. 10 is a graph illustrating a relationship between correlation coefficient and gain.

For example, as illustrated in FIG. 10, when the sampling frequency is 8 kHz and the arranged interval between the microphones MIC1 and MIC2 is 4.2 cm, the relationship between r(t) and g(t) is such that g(t)/r(t)=1.0, except for the lower limit value α. Also, when the arranged interval between the microphones MIC1 and MIC2 is 2.1 cm, the relationship between r(t) and g(t) is such that g(t)/r(t)=0.5.

An operator sets β according to the arranged interval between the microphones MIC1 and MIC2 for the microphone array apparatus 100, provided that β=g(t)/r(t).

The gain calculator 116 calculates gain g(t) to reduce noise, in accordance with Equation (29), based on the correlation coefficient r(t).

$$g(t)=\max(\beta\cdot r(t),\alpha) \tag{29}$$

Incidentally, other configurations and advantageous effects of the microphone array apparatus according to the sixth embodiment are the same as those of the first embodiment, and therefore, description thereof will be omitted.

As described above, the microphone array apparatus according to the sixth embodiment can set a relationship β between a correlation coefficient and gain to reduce noise, according to intervals at which the microphones are arranged. Thereby, even if the microphones are arranged at varying intervals, the microphone array apparatus can reduce the noise in the sound signals from the plural microphones according to the arranged interval between the microphones. Further, the microphone array apparatus can reduce reduction of a sound other than the noise.

Next, an example of experiment performed using an approach of the above-described first embodiment will be described.

Figure 11A:
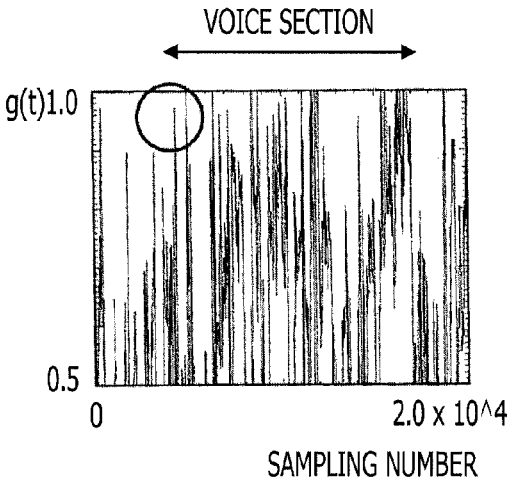
FIG. 11A is a graph illustrating gain calculated by an approach using the related art.
Figure 11B:
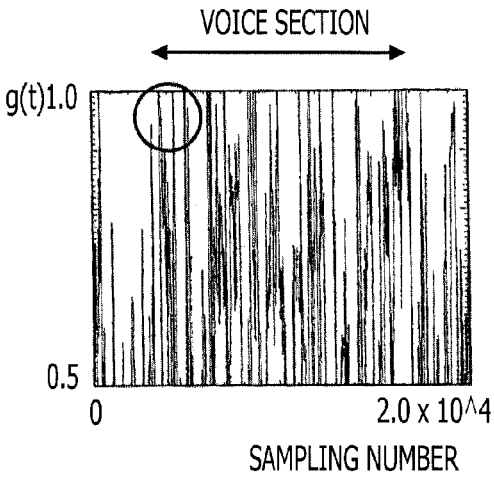
RELATED ART FIG. 11B
FIG. 11B is a graph illustrating gain calculated by an approach of the first embodiment.
Figure 13:
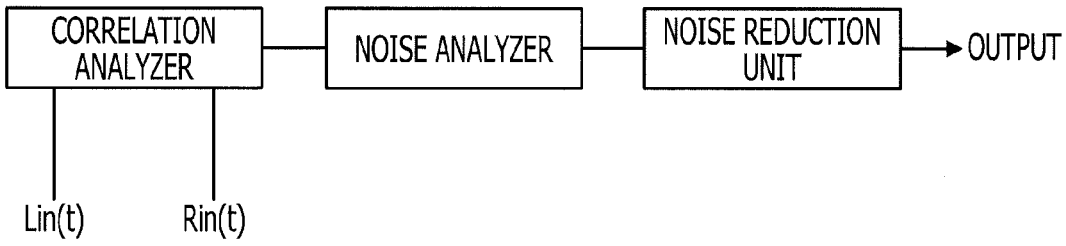
FIG. 13 RELATED ART
FIG. 13 is a functional block diagram of a microphone array apparatus of the related art.

FIGS. 11A and 11B are graphs illustrating gain g(t) calculated by the microphone array apparatuses in environment where a wind does not blow against the microphone array apparatuses. The microphone array apparatus according to the embodiment and the microphone array apparatus according to the related art illustrated in FIG. 13 calculate the gain g(t). FIG. 11A illustrates the gain calculated by the microphone array apparatus according to the related art. Also, FIG. 11B illustrates the gain calculated by the microphone array apparatus according to the first embodiment. With an approach using the related art, even though wind noise is not produced, a reduction process for an input signal is performed in large amounts, particularly in a circled section in FIG. 11A. Incidentally, the circled section is the start of a sound and corresponds to the head of a sound section. Meanwhile, in FIG. 11B illustrating the approach of the first embodiment, the reduction process is not performed in the sound section in large amounts such as are observed in FIG. 11A.

Also, when a mixed sound of wind noise and a sound is inputted to the microphone array apparatus according to the above-described first embodiment, the microphone array apparatus reduces the wind noise to 10 dB, while maintaining the level of the sound.

Incidentally, in the above-described second and third embodiments, description has been given taking an instance where the microphone array apparatus uses the power ratio LR(t) or 1/LR(t) as the correction coefficient to calculate the gain; however, the embodiments are not so limited. For example, the microphone array apparatus may use the correction coefficient according to a difference in power to calculate the gain.

Also, although description has been given taking an instance where the microphone array apparatus calculates the power ratio based on the ratio of Rpow(t) to Lpow(t), the embodiments are not so limited. The microphone array apparatus may calculate the power ratio based on the ratio of Lpow(t) to Rpow(t).

Also, the microphone array apparatus is not particularly limited in hardware mechanism.

Figure 12:
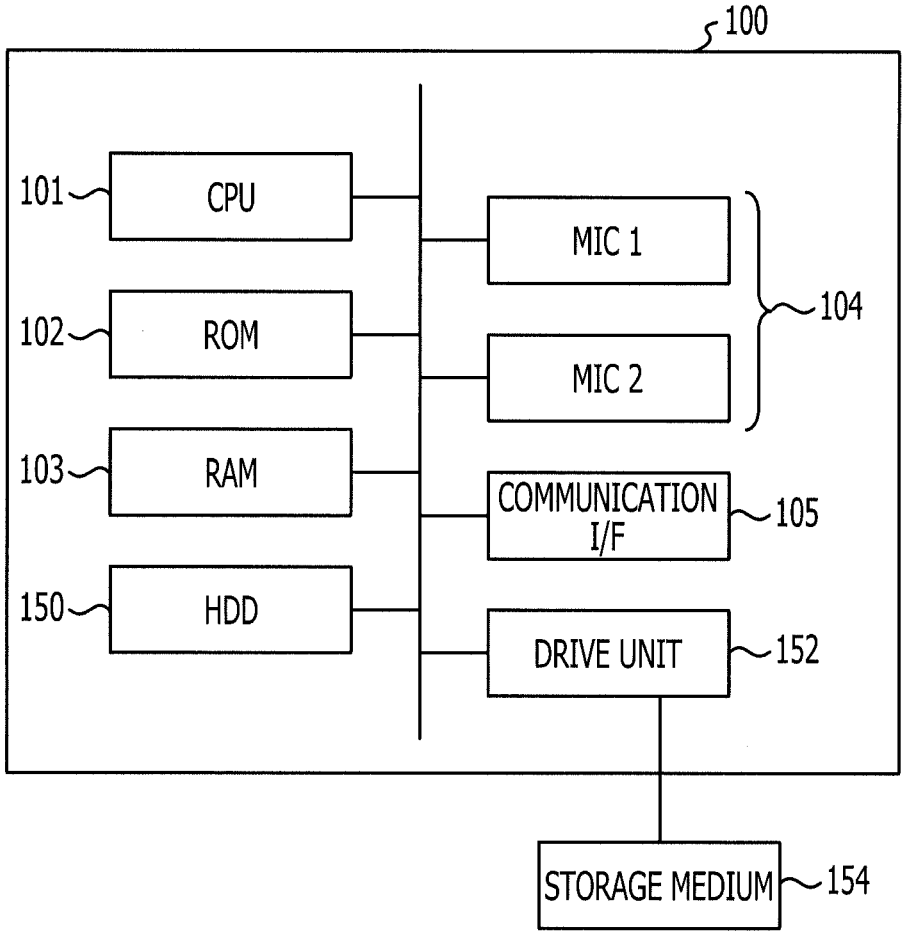
FIG. 12 is a diagram illustrating another example of configuration of a microphone array apparatus.

Further, description has been given with regard to a form in which the program to execute the noise reduction process routine is stored in the ROM 102; however, the program may be provided as being stored in a portable storage medium such as CD-ROM, DVD-ROM, or USB memory. For example, as illustrated in FIG. 12, a storage medium 154 such as CD-ROM, DVD-ROM, or USB memory, storing the program to execute the noise reduction process routine, is loaded in a drive unit 152 of the microphone array apparatus 100. Then, the program to execute the noise reduction process routine is installed from the storage medium 154 via the drive unit 152 into HDD 150.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A microphone array apparatus comprising:

a processor to execute acquiring samples from a sound signal inputted from each of a plurality of microphones, at predetermined time intervals, calculating a value based on volumes of the sound signal possessed by a plurality of the samples for each sound signal inputted from the plurality of microphones, calculating a coefficient of correlation between sound signals, based on the values calculated for the sound signals, and calculating reduction gain for the sound signals inputted from the plurality of microphones, based on the coefficient of correlation; and a memory to store the sound signals and the values.

2. The microphone array apparatus according to claim 1, wherein the processor further executes performing a reduction process on the sound signals by using the reduction gain.

3. The microphone array apparatus according to claim 1, wherein, in the calculating of the value, the processor calculates the value based on a number of the samples according to a distance between the plurality of microphones, a predetermined time interval and a sound velocity.

4. The microphone array apparatus according to claim 1, wherein, in the calculating of the reduction gain, the processor calculates the reduction gain for a second sound signal having a value larger than a first sound signal has, using a coefficient of correction according to a difference or ratio between the values calculated for the respective sound signals.

5. The microphone array apparatus according to claim 1, wherein, in the calculating of the value, the processor calculates the value by calculating a sum or average of a volume of the sound signal possessed by the plurality of samples.

6. The microphone array apparatus according to claim 1, wherein, in the calculating of the value, the processor calculates the value based on powers of the sound signal possessed by the plurality of samples.

7. The microphone array apparatus according to claim 1, wherein, in the calculating of the value, the processor calculates the value based on absolute values of amplitudes of the sound signal possessed by the plurality of samples.

8. The microphone array apparatus according to claim 1, wherein the processor further executes performing frequency analysis on each of the plurality of sound signals acquired, in analysis frame units, and wherein:

in the calculating of the value, calculating the value for each of frequency components, in the calculating of the coefficient of correlation, calculating the coefficient of correlation for each of the frequency components, and in the calculating of the reduction gain, calculating the reduction gain for each of the frequency components.

9. A non-transitory storage medium storing a noise reduction program that causes a computer to execute operations, the operations comprising:

acquiring samples from a sound signal inputted from each of a plurality of microphones, at predetermined time intervals;

calculating a value based on volumes of the sound signal possessed by a plurality of the samples, for each sound signal inputted from the plurality of microphones;

calculating a coefficient of correlation between sound signals, based on the values calculated for the respective sound signals; and calculating reduction gain for the sound signals inputted from the plurality of microphones, based on the coefficient of correlation.

10. A noise reduction method executed by a processor comprising:

acquiring samples from a sound signal inputted from each of a plurality of microphones, at predetermined time intervals;

calculating a value based on volumes of the sound signal possessed by a plurality of the samples for each sound signal inputted from the plurality of microphones;

calculating a coefficient of correlation between sound signals, based on the values calculated for the sound signals, by the processor; and calculating reduction gain for the sound signals inputted from the plurality of microphones, based on the coefficient of correlation.

11. The noise reduction method according to claim 10, further comprising:

performing a reduction process on the sound signals by using the reduction gain.

12. The noise reduction method according to claim 10, wherein the calculating of the value calculates the value based on a number of the samples according to a distance between the plurality of microphones, a certain time interval and a sound velocity.

13. The noise reduction method according to claim 10, wherein the calculating of the reduction gain calculates the reduction gain for a second sound signal having a value larger than a first sound signal, using a coefficient of correction according to a difference or ratio between the values calculated for the respective sound signals.

14. The noise reduction method according to claim 10, wherein the calculating of the value calculates the value by calculating a sum or average of the volume of the sound signal possessed by the plurality of samples.

15. The noise reduction method according to claim 10, wherein the calculating of the value calculates the value based on powers of the sound signal possessed by the plurality of samples.

16. The noise reduction method according to claim 10, wherein the calculating of the value calculates the value based on absolute values of amplitudes of the sound signal possessed by the plurality of samples.

17. The noise reduction method according to claim 10, further comprising:

performing frequency analysis on each of the plurality of sound signals acquired, in analysis frame units, and wherein:

the calculating of the value calculates the value for each of frequency components, the calculating of the coefficient of correlation calculates the coefficient of correlation for each of the frequency components, and the calculating of the reduction gain calculates the reduction gain for each of the frequency components.

* * * * *